US008910505B2

(12) United States Patent
VanWie et al.

(10) Patent No.: US 8,910,505 B2
(45) Date of Patent: Dec. 16, 2014

(54) SYSTEM AND METHOD FOR SIMULATING PRIMARY AND SECONDARY BLAST

(75) Inventors: David M. VanWie, Brookeville, MD (US); Ibolja Cernak, Columbia, MD (US); Andrew C. Merkle, Gaithersburg, MD (US)

(73) Assignee: The Johns Hopkins University, Baltimore, MD (US)

( * ) Notice: Subject to any disclaimer, the term of this patent is extended or adjusted under 35 U.S.C. 154(b) by 367 days.

(21) Appl. No.: 13/425,488

(22) Filed: Mar. 21, 2012

(65) Prior Publication Data

US 2013/0247646 A1 Sep. 26, 2013

(51) Int. Cl.
*G01M 7/00* (2006.01)

(52) U.S. Cl.
USPC ..... 73/12.08

(58) Field of Classification Search
USPC ..... 73/12.01, 12.04, 12.08, 12.09
See application file for complete search history.

(56) References Cited

U.S. PATENT DOCUMENTS

| | | | | |
|---|---|---|---|---|
| 2,998,719 | A | 9/1955 | Rubin | |
| 2,836,063 | A | 2/1956 | Yoler et al. | |
| 2,832,665 | A * | 4/1958 | Hertzberg et al. | 423/405 |
| 2,958,716 | A * | 11/1960 | Lahr et al. | 204/157.62 |
| 2,966,793 | A * | 1/1961 | Mullaney et al. | 73/35.17 |
| 3,087,840 | A * | 4/1963 | Shaw | 366/108 |
| 3,184,097 | A * | 5/1965 | Kilmer et al. | 220/260 |
| 3,260,103 | A * | 7/1966 | Johnson | 73/12.08 |
| 3,342,048 | A * | 9/1967 | Johnson et al. | 72/56 |
| 3,374,668 | A * | 3/1968 | Godfrey | 73/147 |
| 3,618,380 | A | 11/1968 | Marston et al. | |
| 3,431,777 | A * | 3/1969 | Norfieet Glenn D | 73/147 |
| 3,495,455 | A * | 2/1970 | Allgood | 73/147 |
| 3,555,878 | A * | 1/1971 | Slutsky et al. | 73/12.08 |
| 3,817,096 | A | 6/1974 | Osofsky | |
| 3,983,749 | A * | 10/1976 | Fletcher et al. | 73/147 |
| 4,367,130 | A * | 1/1983 | Lemelson | 204/157.42 |
| 4,696,182 | A * | 9/1987 | Meir | 73/12.07 |
| 4,878,488 | A * | 11/1989 | Naser et al. | 601/4 |
| 5,197,323 | A | 3/1993 | Osofsky | |
| 6,763,696 | B1 | 7/2004 | Thomas et al. | |
| 2003/0066337 | A1 * | 4/2003 | Gauthier, Jr. et al. | 73/31.05 |
| 2006/0069395 | A1 * | 3/2006 | Lebet | 606/127 |
| 2008/0127737 | A1 | 6/2008 | Berman | |
| 2011/0191039 | A1 * | 8/2011 | Svetlov et al. | 702/50 |
| 2013/0042665 | A1 * | 2/2013 | Ritzel et al. | 73/12.08 |
| 2013/0186173 | A1 * | 7/2013 | Ravin et al. | 73/12.08 |

FOREIGN PATENT DOCUMENTS

| | | | |
|---|---|---|---|
| DE | 2404449 A | * | 8/1975 |
| JP | 9079938 | | 3/1997 |
| JP | H09079938 A | * | 3/1997 |
| SU | 0953482 A1 | * | 8/1982 |

* cited by examiner

*Primary Examiner* — Max Noori
(74) *Attorney, Agent, or Firm* — Noah J. Hayward

(57) ABSTRACT

A blast tube includes three portions and three diaphragms. The first portion has a first length and a first cross section. The second portion has a second length and a second cross section. The third portion has a third length and a third cross section. The first diaphragm is disposed between the second portion and the third portion and switches from a closed state to an open state at a first time. The second diaphragm switches from a closed state to an open state at a second time after the first time. The third diaphragm is disposed between the first portion and the second portion and switches from a closed state to an open state at a third time after the second time. The third portion is disposed between the first diaphragm and the second diaphragm.

19 Claims, 10 Drawing Sheets

SYSTEM AND METHOD FOR SIMULATING PRIMARY AND SECONDARY BLAST

BACKGROUND OF THE INVENTION

1. Field of the Invention

Example embodiments of the present invention generally relate to shock tube devices and, more particularly, to shock tube devices that generate multiple, e.g., primary and secondary, shock waves.

2. Description of the Related Art

Shock tube assemblies are used to simulate static and dynamic pressure conditions resulting from large energy blasts. These large energy blasts may be the result of conventional explosive detonation or nuclear detonation, for example. By simulating the conditions of such blasts without an actual full scale detonation, it is possible to evaluate the effects of such blasts on various types of equipment ranging from relatively small test articles, such radios, to relatively large test articles, such as full-size operational shelters, vehicles, tanks and aircraft. In effect, the shock tube assembly is a specialized short duration wind tunnel used for test and evaluation of various structures. Typically, a shock tube assembly includes various sections, such as a driver section containing a pressurized gas which is ultimately used to create the shock wave, a diaphragm section to suddenly release the driver gas, an expansion nozzle section to port the driver gas into a test chamber, along with associated gas processing and support equipment. The test article to be tested is placed in the test section. The driver is normally a hollow cylindrical pressure vessel with one end closed and sealed at the other end by the diaphragm section and capable of holding room temperature or elevated temperature gas at substantial pressure. The diaphragm section, associated with the driver, includes one or more diaphragms which are ruptured to release the gas in the driver, i.e., the shock tube diaphragm is mechanically, explosively or pressure ruptured to suddenly release the gas from the driver. In a dual diaphragm system, only one diaphragm is ruptured and the higher pressure differential imposed on the second diaphragm bursts it to release the gas. From the diaphragm section, the gas flows through the expander nozzle section, the discharge end of which is located within the expansion tube. The gas flowing through the nozzle section is supersonically expanded within the expansion chamber to create a shock wave which travels down the elongated expansion tube, compressing the air behind the travelling shock wave interface thereby providing both the static and dynamic pressure conditions and temperature conditions for testing and evaluating the test article located within the expansion tube and which is exposed to the static and dynamic pressure generated by the shockwave.

As mentioned above, the structure of classical and currently utilized blast tube is composed of a high pressure tubular section and a low pressure tubular section separated by a diaphragm. A diaphragm is a device, typically surface, that can change from a first state to a second state. In the first state, or closed state, the diaphragm acts as a barrier between the high pressure tubular section and the low pressure tubular section. In the second state, or open state, the diaphragm allows mixing between the high pressure tubular section and the low pressure tubular section.

The effectiveness of the shockwave is dependent on how rapidly and completely the designed system can switch from an open state to a closed state. The quicker that the diaphragm can switch to an open state is directly correlated to the characteristics and reproducibility of a shockwave.

Current, compressed-air driven blast tubes usually use one or two single or double diaphragms, which are placed between the high pressure and low pressure sections. In this configuration, blast tubes are only capable of generating single shock waves. Current blast tubes are not capable of reproducing multiple shock waves nor are they able to modify blast wave characteristics such as shape, duration, or peak.

Another type of blast tube system that is currently in operation utilizes explosives to generate blast waves. The choice and availability of explosives is a significant limit when it comes to broader research applications. Blast tube systems that utilize explosives for shock wave generation need complex and sophisticated control systems. These types of shock tubes also are subject to stringent safety measures.

There are several blast tubes, such as the ones at the University of Central Florida, City College of New York, and the Aerospace Corporation in El Segundo, Calif., but these existing shock tubes are only able to reproduce non-ideal blast conditions. More particularly, existing blast tubes lack the ability to replicate multiple shock waves.

Operation of one type of conventional blast tube system will now be described with reference to FIGS. 1-2.

FIG. 1 illustrates a conventional blast tube system 100.

As illustrated in the figure, system 100 includes a tube section 102, a tube section 104, a test chamber 106, a diaphragm 108, a diaphragm 110, a detector 112, an inlet valve 114, an inlet valve 116, an outlet valve 118, an outlet valve 120, a compressor 122 and a controller 124.

Tube section 102 has an end wall 126 and an open end 128. Tube section 104 has an open end 130 and another open end 132. Test chamber 106 has an open end 134 and an end 136 that can be open or closed. Test chamber 106 contains detector 112 positioned at end 136.

Tube section 102 is arranged such that open end 128 is adjacent to open end 130 of tube section 104. Further, test chamber 106 is arranged such that open end 134 is adjacent to open end 132 of tube section 104. Detector 112 is disposed at closed end 136 of test chamber 106.

Compressor 122 is arranged to receive compressor control signal 138 from controller 124.

Inlet valve 114 is arranged to receive a fluid through fluid line 148 from compressor 122. Additionally, inlet valve 114 is arranged to receive inlet valve control signal 140 from controller 124. Inlet valve 116 is arranged to receive a fluid through fluid line 150 from compressor 122. Additionally, inlet valve 116 is arranged to receive inlet valve control signal 142 from controller 124. Outlet valve 118 is arranged to receive outlet valve control signal 144 from controller 124. Outlet valve 120 is arranged to receive outlet valve control signal 146 from controller 124.

Tube section 102 and tube section 104 are able to receive and store a fluid at a predetermined temperature, pressure, and volume. Tube section 102 and tube section 104 may be any known device or system that is able to receive and store a fluid at a predetermined temperature, pressure, and volume. Non-limiting examples of tube section 102 and tube section 104 include pipes, drums and containers.

Test chamber 106 is able to contain a shockwave and expansion of fluid created in tube section 102 and tube section 104. Test chamber 106 may be any known device or system that will allow the expansion of a fluid to propagate through itself. Non-limiting examples of test chamber 106 include a closed pipe, open end pipe and chamber.

Diaphragm 108 acts as a controllable barrier between tube section 102 and tube section 104. In a first state, or closed state, diaphragm 108 prevents the mixing of fluids from tube section 102 and tube section 104. In a second state, or open state, diaphragm 108 is open and allows the flow of fluid from tube section 102 into tube section 104, creating a primary shockwave.

Diaphragm 110 acts as a controllable barrier between tube section 104 and test chamber 106. In a first state, or closed state, diaphragm 110 prevents the passage of fluid from tube section 104 into test chamber 106. In a second state, or open state, diaphragm 110 is open and allows a shock wave and fluid from tube section 102 and tube section 104 to propagate into test chamber 106.

Diaphragm 108 and diaphragm 110 may be any known devices or system that is operable to be closed in a first state and open in a second state. Non-limiting examples of diaphragm 108 and diaphragm 110 include a thin membrane, valve and scored plate.

Detector 112 detects the pressure inside of test chamber 106. Detector 112 may be any known device or system that is able to detect pressure inside of test chamber 106. Non-limiting examples of detector 112 include a barometer and a piezoelectric sensor.

Inlet valve 114 allows fluid to flow from compressor 122, by way of fluid line 148, into tube section 102. Inlet valve 114 is controlled by controller 124 through inlet valve control signal 140. Inlet valve 116 allows fluid to flow from compressor 122, by way of fluid line 150, into tube section 104. Inlet valve 116 is controlled by controller 124 through inlet valve control signal 142.

Inlet valve 114 and inlet valve 116 may be any known device or system that allows unidirectional fluid flow from compressor 122. Non-limiting examples of inlet valve 114 and inlet valve 116 include a globe valve, gate valve or needle valve.

Outlet valve 118 allows the flow of fluid out of tube section 102. Outlet valve 118 is controlled by controller 124 by outlet valve control signal 144. Outlet valve 120 allows the flow of fluid out of tube section 104. Outlet valve 120 is controlled by controller 124 through outlet valve control signal 146.

Outlet valve 118 and outlet valve 120 may be any known device or system that allows unidirectional fluid flow from tube section 102 and tube section 104. Non-limiting examples of outlet valve 118 and outlet valve 120 include a globe valve, gate valve and needle valve.

Compressor 122 provides a fluid under a controlled flow rate and/or pressure to inlet valve 114. Additionally, compressor 122 provides a fluid under a controlled flow rate and/or pressure to inlet valve 116. Compressor 122 IS controlled by controller 124 through compressor control signal 138.

Compressor 122 may be any known device or system that is able to provide a fluid under a controlled flow rate and/or pressure to inlet valve 114 and inlet valve 116. Non-limiting examples of compressor 122 include a centrifugal compressor, mixed flow compressor or axial flow compressor.

Controller 124 may be any known device or system that is able to control compressor 122, inlet valve 114, inlet valve 116, outlet valve 118, outlet valve 120, and detector 112. Non-limiting examples of controller 124 include a computer and a server.

In operation, system 100 is used to generate a controlled blast for study. Initial parameters are set for a particular test. The starting temperature and pressure in each of tube section 102 and tube section 104 are predetermined in order to study a resulting blast. To achieve the starting temperature and pressure, a user inputs the associated predetermined fluid temperature, pressure and volume into controller 124 through a user interface (not shown). With temperature, pressure, and volume known, controller 124 can send compressor control signal 138 to compressor 122. Compressor control signal 138 will instruct compressor 122 to begin pumping fluid into tube section 102 and tube section 104.

Fluid is pumped at a predetermined flow rate and/or pressure to inlet valve 114 and inlet valve 116. Fluid is unable to pass through inlet valve 114 and inlet valve 116 until they are opened by controller 124, via inlet valve control signal 148 and inlet valve control signal 150.

Once inlet valve 114 and inlet valve 116 are open, fluid is pumped into tube section 102 and tube section 104, by compressor 122. When controller 124 has calculated that the amounts of fluid in tube section 102 and tube section 104 have reached the predetermined temperature, pressure, and volume limits, it sends compressor control signal 138 to indicate compressor 122 should shut down.

Simultaneously, controller 124 sends inlet valve control signal 148 to inlet valve 114 and inlet valve control signal 150 to inlet valve 116 indicating that they should close to prevent the flow of fluid into tube section 102 and tube section 104.

Once fluid in tube section 102 and tube section 104 reaches a predetermined temperature, pressure, and volume, a user may enter time variables into controller 124 through a user interface. In some embodiments, time variables may be preset. The time variables are used to control the opening of diaphragm 108 and diaphragm 110.

There are several methods of opening a diaphragm in a blast tube system. One example method of opening a diaphragm is to have the diaphragm electrically actuated. In this method when the diaphragm receives a signal, it will open through electro-mechanical means. Another example method of opening a diaphragm is to have a diaphragm with a set pressure tolerance, and when the pressure tolerance is exceeded, the diaphragm ruptures allowing fluid to flow from tube section 102 to tube section 104. Another example method of opening a diaphragm is to have a diaphragm with a set temperature tolerance, and when the temperature tolerance is exceeded, the diaphragm ruptures allowing fluid to flow from tube section 102 into tube section 104.

Any of the above mentioned diaphragm control methods may be used individually or in conjunction with one another to achieve precise diaphragm timing.

For purposes of discussion, in this example embodiment, diaphragm 108 is electrically actuated, wherein control signal 152 will provide a voltage as to open diaphragm 108. Also in this example embodiment, diaphragm 110 is electrically actuated, wherein control signal 154 will provide a voltage as to open diaphragm 110.

At time $t_1$, controller 124 will send diaphragm control signal 152 to diaphragm 108 indicating that it should switch from a closed state to an open state. When diaphragm 108 is switched to an open state, the temperature and pressure differential between tube section 102 and tube section 104 will facilitate the generation of a shockwave. The resultant shockwave will propagate from tube section 102 and tube section 104 towards test chamber 106.

At time $t_2$, controller 124 will send diaphragm control signal 154 to diaphragm 110 indicating that it should switch from a closed state to an open state. This state change will allow the shockwave to propagate into test chamber 106. When the shock wave reaches test chamber 106, detector 112 will measure the pressure and temperature differentials that are created.

The detector will continue to measure temperature and pressure inside of test chamber 106 until the fluid reaches a state of equilibrium. Once the fluid has reached a state of equilibrium controller 124 will send outlet valve control signal 144 to outlet valve 118 and outlet valve control signal 146 to outlet valve 120. This will indicate that outlet valve 118 and outlet valve 120 should switch from a closed state to an open state. When outlet valve 118 and outlet valve 120 are open, fluid can be vented out of shock tube system 100.

FIG. 2 is a graph that illustrates the pressure at detector 112 inside of the shock tube system 100 described in FIG. 1 as a function of time.

As illustrated in FIG. 2, graph 200 includes a y-axis 202, an x-axis 204, and a function 206. Function 206 includes a function segment 208, a function segment 210, and a function segment 212. Y-axis 202 is pressure measured by detector 112 in Torr, whereas x-axis 204 is time in milliseconds.

Function segment 208 has a constant pressure $p_0$ from time $t_0$ to time $t_1$. Function segment 210 has a maximum pressure $p_1$ from time $t_1$ to time $t_2$. Function segment 212 decreases from pressure $p_1$ to pressure $p_0$ from time $t_2$ to time $t_3$.

In operation, at time $t_0$ diaphragm 108 is in a closed state and acts as a barrier between tube section 102 and tube section 104. Additionally at time $t_0$, diaphragm 110 is in a closed state and acts as a barrier between tube section 104 and test chamber 106. When tube section 102, tube section 104, and test chamber 106, are separated by diaphragm 108 and diaphragm 110, the pressure inside of shock tube system 100 is at a constant $p_0$ as shown by function segment 208.

Function segment 210 represents the opening of diaphragm 108 at time $t_1$. At time $t_1$, diaphragm 108 switches from a closed state to an open state, allowing the flow of fluid from tube section 102 into tube section 104. The volume, temperature, and pressure differentials between tube section 102 and tube section 104 creates a primary shock with pressure $p_1$.

The primary shock propagates from tube section 102 and tube section 104 towards test chamber 106 at a constant pressure $p_1$ from time $t_1$ to time $t_2$.

At time $t_2$, diaphragm 110 switches from a closed state to an open state allowing the primary shock to propagate into test chamber 106. When the primary shock enters test chamber 106, it begins to expand as the fluids begin to reach equilibrium in shock tube system 100.

Function segment 212 represents the expansion of the primary shock inside of test chamber 106. At time $t_2$ the primary shock enters test chamber 106 and begins to equalize. This equalization continues until the fluid in test chamber 106 equalizes to a pressure higher than $p_0$ at time $t_3$.

Enhanced blast weaponry such as thermobaric bombs and nuclear devices create shockwaves with multiple shock wavefronts as well as multiple expansion wavefronts. Since conventional shock tubes are only able to create single wavefronts they are not suitable for biomedical research on enhanced blast weaponry injuries and damage mitigation, for example.

What is therefore needed is a system and method that generates a primary and secondary shockwave. Moreover, a system that creates multiple shockwaves will provide researchers with additional fundamental understanding of how multiple shock wavefronts work. With better knowledge of how multiple shock wavefronts work, researchers will, for example, be able to develop methods for injury prediction, injury treatment, and damage mitigation.

SUMMARY OF THE INVENTION

Example embodiments of the present invention include a system and method that generates a primary and secondary shockwave.

In accordance with example embodiments of the present invention, a blast tube includes three portions and three diaphragms. The first portion has a first length and a first cross section. The second portion has a second length and a second cross section. The third portion has a third length and a third cross section. The first diaphragm can switch from a closed state to an open state at a first time and is disposed between the second portion and the third portion. The second diaphragm switches from a closed state to an open state at a second time after the first time. The third diaphragm is disposed between the first portion and the second portion and switches from a closed state to an open state at a third time after the second time. The third portion is disposed between the first diaphragm and the second diaphragm.

Additional advantages and novel features of the example embodiments of the invention are set forth in part in the description which follows, and in part will become apparent to those skilled in the art upon examination of the following or may be learned by practice of the example embodiments described herein. The advantages of example embodiments of the invention may be realized and attained by means of the instrumentalities and combinations particularly pointed out in the appended claims.

BRIEF DESCRIPTION OF THE DRAWINGS

The accompanying drawings, which are incorporated in and form apart of the specification, illustrate example embodiments and, together with the description, explain the principles of example embodiments of the invention. In the drawings.

DETAILED DESCRIPTION

One or more example embodiments of the present invention include a system and method that generates both a primary shockwave and a secondary shockwave.

In example embodiments, the creation of both primary and secondary shockwaves is accomplished by having three tubular sections and two diaphragms. The first diaphragm opens to create the primary shockwave between one blast tube section and another. Thereafter, a second diaphragm opens to generate the secondary shockwave.

The blast tube system features interchangeable pipe segments and double diaphragms. Utilization of various pipe segments allows for the reconfiguration of the overall chamber length, and consequently the primary shockwave peak timing can be controlled.

Using interchangeable pipe segments also allows for the replication of different shockwave types, such as conventional or non-conventional, as well as different atmospheric conditions, such as open field or confined space.

Double diaphragms may be used to control the timing between generation of a primary shock and the generation of a secondary shock. The diaphragms are able to be opened in a variety of methods such as using a pressure differential, electrical actuation, or temperature differentials. The various methods for opening the diaphragms allow for a high degree of reproducibility.

Each section of the blast tube system may be designed to have an initial state, including controlling parameters such as length, pressure, and temperature. Each one of these parameters may be controlled as to derive many different blast simulations.

Example systems in accordance with embodiments of the present invention will now be described with reference to FIGS. 3-9.

Figure 3:
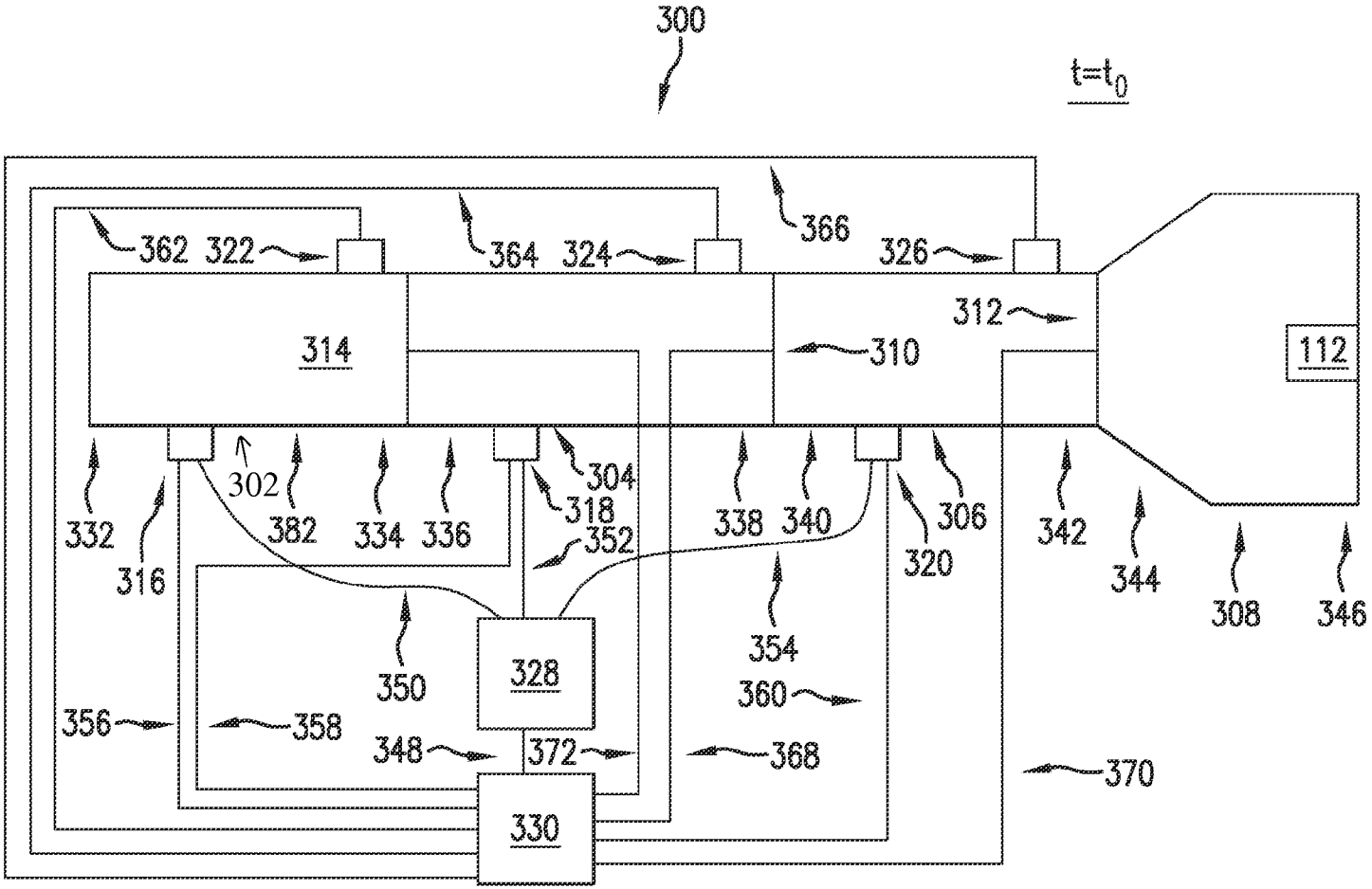
FIG. 3 illustrates an example shock tube system in accordance with an example embodiment of the present invention.

FIG. 3 illustrates an example shock tube system 300 in accordance with an example embodiment of the present invention at time $t_0$.

As illustrated in the figure system 300 includes detector 112, a first portion 302 (e.g., a first tube section 302), a second portion 304 (e.g., a second tube section 304), a third portion 306 (e.g., a third tube section 306), an test chamber 308, a first diaphragm 310, a second diaphragm 312, a third diaphragm 314, an inlet valve 316, an inlet valve 318, an inlet valve 320, an outlet valve 322, an outlet valve 324, an outlet valve 326, a compressor 328 and a controller 330.

Tube section 302 has an end wall 332 and an open end 334. Tube section 302 has length $l_1$ (FIG. 6) and cross section (e.g., cross-sectional area) $c_1$. Tube section 304 has an open end 336 and another open end 338. Tube section 304 has a length $l_2$ and cross section $c_2$. Tube section 306 has an open end 340 and another open end 342. Tube section 306 has a length l3 and cross section $c_3$. Test chamber 308 has an open end 344 and a closed end 346. Test chamber 308 contains detector 112 positioned at closed end 346.

Tube section 302 is arranged such that open end 334 is adjacent to open end 336 of tube section 304. Further, tube section 306 is arranged such that open end 340 is adjacent to open end 338 of tube section 304. Further, test chamber 308 is arranged such that open end 344 is adjacent to open end 342 of tube section 306. Detector 112 is disposed at closed end 346 of test chamber 308.

Compressor 328 is arranged to receive compressor control signal 348 from controller 330.

Inlet valve 316 is arranged to receive a fluid through fluid line 350 from compressor 328. Additionally, inlet valve 316 is arranged to receive inlet valve control signal 356 from controller 330. Inlet valve 318 is arranged to receive fluid through fluid line 352 from compressor 328. Additionally, inlet valve 318 is arranged to receive inlet valve control signal 358 from controller 330. Inlet valve 320 is arranged to receive fluid through fluid line 354 from compressor 328. Additionally, inlet valve 320 is arranged to receive inlet valve control signal 360 from controller 330.

Outlet valve 322 is arranged to receive outlet valve control signal 362 from controller 330. Outlet valve 324 is arranged to receive outlet valve control signal 364 from controller 330. Outlet valve 326 is arranged to receive outlet valve control signal 366 from controller 330.

Tube section 302, tube section 304 and tube section 306 are able to house a fluid at a predetermined temperature, pressure and volume. Tube section 302, tube section 304 and tube section 306 may be any known device or system that is able to receive and store fluid at a predetermined temperature, pressure and volume. Non-limiting examples of tube section 302, tube section 304 and tube section 306 include pipes, drums and containers.

Test chamber 308 is able to contain a shockwave and expansion of fluid created in tube section 304 and tube section 306. Additionally, test chamber 308 is able to contain a secondary shockwave and secondary expansion of fluid created by tube section 302. Test chamber 308 may be any known device or system that will allow the expansion of a fluid to propagate through itself. Non-limiting examples of test chamber 308 include a closed pipe, open ended pipe or chamber.

Diaphragm 310 is operable to act as a controllable barrier between tube section 304 and tube section 306. In a first state, or closed state, diaphragm 310 prevents the mixing of fluids from tube section 304 and tube section 306. In a second state, or open state, diaphragm 310 is open and allows a mixing of fluids from tube section 304 and tube section 306, creating a primary shockwave.

Diaphragm 312 is operable to act as a controllable barrier between tube section 306 and test chamber 308. In a first state, or closed state, diaphragm 312 prevents the passage of fluid from tube section 306 into test chamber 308. In a second state, or open state, diaphragm 312 is open and allows the primary shock wave and fluid from tube section 304 and tube section 306 to propagate into test chamber 308.

Diaphragm 314 is operable to act as a controllable barrier between tube section 302 and tube section 304. In a first state, or closed state, diaphragm 314 prevents the mixing of fluid from tube section 302 and tube section 304. In a second state, or open state, diaphragm 314 is open and allows fluid in tube section 302 to enter tube section 304 creating a secondary shockwave.

Diaphragm 310, diaphragm 312, and diaphragm 314 are any known device or system that is operable to be closed in a first state and open in a second state. Non-limiting examples of diaphragm 310, diaphragm 312, and diaphragm 314 include a thin membrane, valve and scored plate.

Inlet valve 316 allows the flow of fluid from compressor 328, by way of fluid line 350, into tube section 302. Inlet valve 316 is controlled by controller 330 through inlet valve control signal 356. Inlet valve 318 allows the flow of fluid from compressor 328, by way of fluid line 352, into tube section 304. Inlet valve 318 is controlled by controller 330 through inlet valve control signal 358. Inlet valve 320 allows the flow of fluid from compressor 328, by way of fluid line 354, into tube section 306. Inlet valve 320 is controlled by controller 330 through inlet valve control signal 360.

Inlet valve 316, inlet valve 318, and inlet valve 320, may be any known device or system that allows unidirectional fluid flow from compressor 328. Non-limiting examples of inlet valve 316, inlet valve 318 and inlet valve 320 include a globe valve, gate valve and needle valve.

Outlet valve 322 allows the flow of fluid out of tube section 302. Outlet valve 322 is controlled by controller 330 through outlet valve control signal 362. Outlet valve 324 allows the flow of fluid out of tube section 304. Outlet valve 324 is controlled by controller 330 through outlet valve control signal 364. Outlet valve 326 allows the flow of fluid out of tube section 306. Outlet valve 326 is controlled by controller 330 through outlet valve control signal 366.

Outlet valve 322, outlet valve 324 and outlet valve 326 may be any known device or system that allows unidirectional fluid flow out of tube section 302, tube section 304 and tube section 306, respectively. Non-limiting examples of outlet valve 322, outlet valve 324 and outlet valve 326 include a globe valve, gate valve and needle valve.

Compressor 328 provides a fluid under a controlled flow rate and/or pressure to inlet valve 316. Additionally, compressor 328 provides a fluid under a controlled flow rate and/or pressure to inlet valve 320. Further, compressor 328 provides a fluid under a controlled flow rate and/or pressure to inlet valve 318.

Compressor 328 is any known device or system that is able to provide a fluid under a controlled flow rate and/or pressure to inlet valve 316, inlet valve 318 and inlet valve 320. Non-limiting examples of compressor 328 include a centrifugal compressor, mixed flow compressor and axial flow compressor.

Controller 330 is operable to control compressor 334, inlet valve 316, inlet valve 318, inlet valve 320, outlet valve 322, outlet valve 324, outlet valve 326 and detector 112.

In operation, a user inputs predetermined fluid temperature, pressure, and volume variables into controller 330 through a user interface (not shown). With temperature, pressure, and volume known, controller 330 can send compressor control signal 348 to compressor 328. Compressor control signal 348 will instruct compressor 328 to begin pumping fluid into tube section 302, tube section 304 and tube section 306.

Non limiting example of fluids used by system 300 include compressed air, nitrogen, an accelerant, or any mixture thereof. Specific materials may be decided in order to provide a particular type of simulation for a desired blast.

Fluid is pumped at a predetermined flow rate and/or pressure to inlet valve 316, inlet valve 318 and inlet valve 320. Fluid is unable to pass through inlet valve 316, inlet valve 318 and inlet valve 320, until they are opened by controller 330 by inlet valve control signal 356, inlet valve control signal 358 and inlet valve control signal 360, respectively.

Once inlet valve 316, inlet valve 318 and inlet valve 320 are open, fluid is pumped into tube section 302, tube section 304, and tube section 306, respectively, by compressor 328. When controller 330 has calculated that the amount of fluid in tube section 302, tube section 304 and tube section 306 has reached the predetermined temperature, pressure, and volume limits, it sends compressor control signal 348 to indicate that compressor 328 should shut down.

Controller 330 sends inlet valve control signal 356 to inlet valve 316, inlet valve control signal 358 to inlet valve 318 and inlet valve control signal 360 to inlet valve 320 indicating that they should close. The closing of inlet valve 316, inlet valve 318 and inlet valve 320 prevents the additional flow of fluid into tube section 302, tube section 304 and tube section 306.

Once the fluid in tube section 302, tube section 304 and tube section 306 has reached a predetermined temperature, pressure, and volume, a user will enter time variables into controller 330 through a user interface. These time variables will control the opening of diaphragm 310, diaphragm 312 and diaphragm 314.

At time $t_1$, controller 330 will send diaphragm control signal 368 to diaphragm 310 indicating that it should switch from a closed state to an open state. When diaphragm 310 is switched to an open state, the temperature and pressure differential between tube section 304 and tube section 306 will generate a primary shockwave. The resultant shockwave will propagate from tube section 304 and tube section 306 towards test chamber 308.

At time $t_2$, controller 330 will send diaphragm control signal 370 to diaphragm 312 indicating that it should switch from a closed state to an open state. This state change will allow the primary shockwave to propagate into test chamber 308. When the primary shockwave reaches test chamber 308, detector 112 will measure the temperature and pressure differentials that are created. Detector 112 will continue to take temperature and pressure measurements as the shockwave expands and dissipates inside of test chamber 308.

At time $t_3$, controller 330 will send diaphragm control signal 372 to diaphragm 314 indicating that it should switch from a closed state to an open state. When diaphragm 314 switches from a closed state to an open state, the temperature and pressure differential between tube section 302 and tube section 304 creates a secondary shockwave. The resultant shockwave will propagate from tube section 302 and tube section 304 towards test chamber 308.

When the secondary shockwave reaches test chamber 308, detector 112 will measure the temperature and pressure differentials that are created. Detector 112 will continue to take temperature and pressure readings until the primary shockwave and secondary shockwave reach a state of equilibrium inside of test chamber 308.

Once the fluid inside of test chamber 308 has reached a state of equilibrium, controller 330 will send outlet valve control signal 362 to outlet valve 322, outlet valve control signal 364 to outlet valve 324, and outlet valve control signal 366 to outlet valve 326. This will indicate that outlet valve 322, outlet valve 324, and outlet valve 326 should switch from a closed state to an open state. Once outlet valve 322, outlet valve 324, and outlet valve 326 are open, fluid can be vented out of shock tube system 300.

FIGS. 4A-D illustrate an example shock tube system 400 in accordance with an example embodiment of the present invention at times $t_0$, $t_1$, $t_2$ and $t_3$.

As illustrated the FIGS. 4A-D, system 400 includes detector 112, tube section 302, tube section 304, tube section 306, test chamber 308, diaphragm 310, diaphragm 312 and diaphragm 314.

As shown in FIG. 4A-D, tube section 302 is arranged such that open end 334 is adjacent to open end 336 of tube section 304. Further, tube section 306 is arranged such that open end 340 is adjacent to open end 338 of tube section 304. Further, test chamber 308 is arranged such that open end 344 is adjacent to open end 342 of tube section 306. Detector 112 is disposed at closed end 346 of test chamber 308.

Figure 4A:
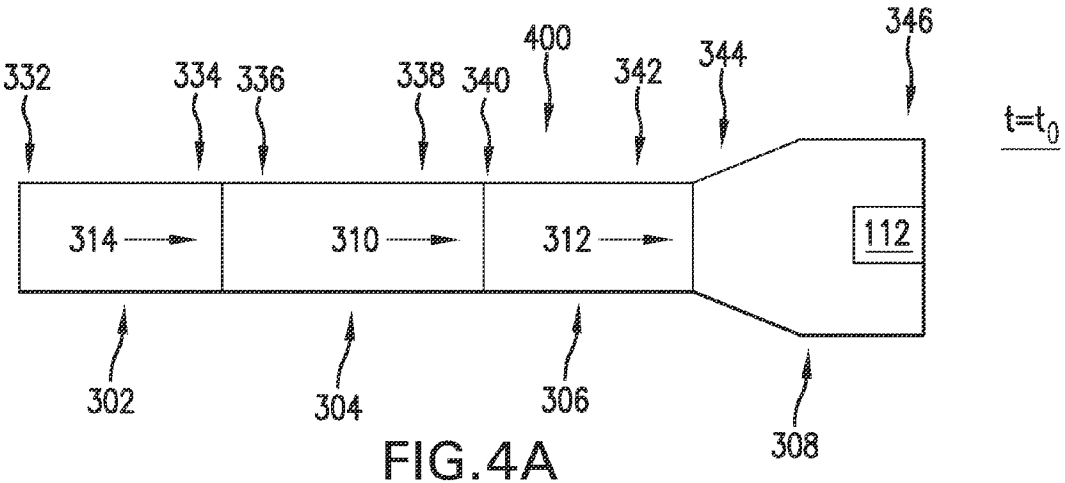
FIGS. 4A-D illustrate an example shock tube system in accordance with an example embodiment of the present invention at time $t_0$, $t_1$, $t_2$, and $t_3$, respectively.

As shown in FIG. 4A, at time $t_0$, diaphragm 310, diaphragm 312 and diaphragm 314 are in a closed state. Diaphragm 310 separates tube section 304 and tube section 306, diaphragm 312 separates tube section 306 and test chamber 308, and diaphragm 314 separates tube section 302 and tube section 304. At time $t_0$, shock tube system 400 is in a state of equilibrium.

Figure 4B:
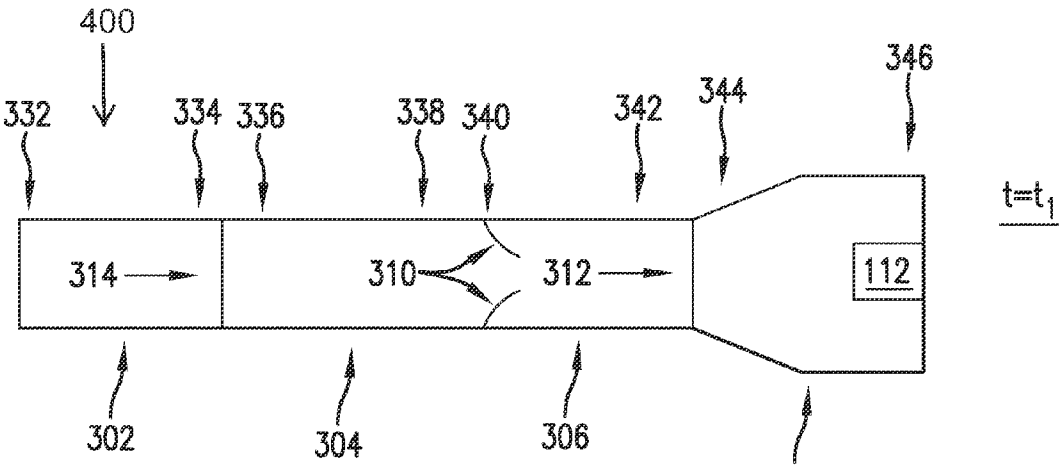

As shown in FIG. 4B, at time $t_1$, diaphragm 310 switches from a closed state to an open state. When diaphragm 310 switches from a closed state to an open state, fluid from tube section 304 and fluid from tube section 306, are able to interact. The temperature and pressure differential between tube section 304 and tube section 306 create a primary shockwave. The resultant shockwave propagates towards test chamber 308.

Figure 4C:
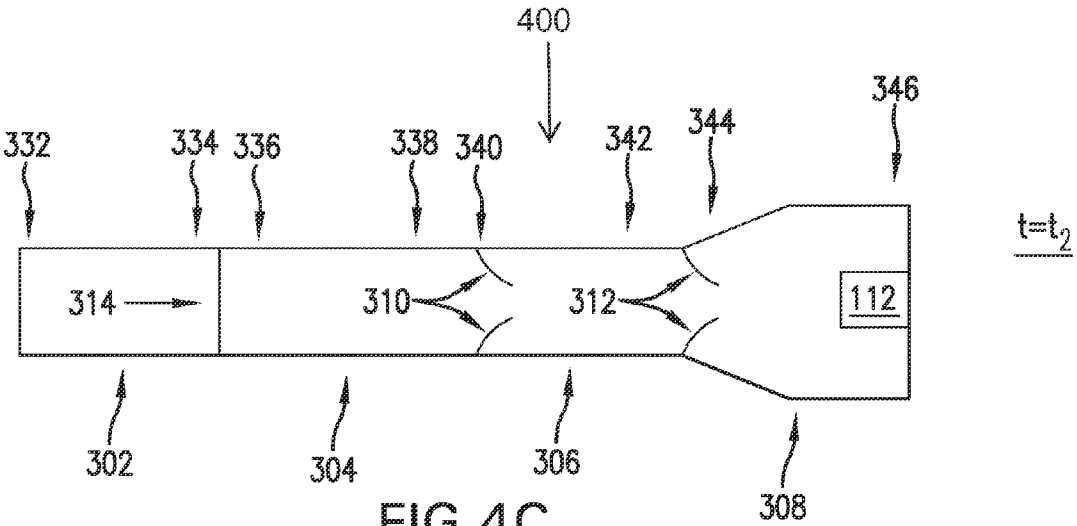

As shown in FIG. 4C, at time $t_2$, diaphragm 312 switches from a closed state to an open state. When diaphragm 312 switches from a closed state to an open state the primary shockwave, created from opening diaphragm 310, is able to propagate into test chamber 308. When the primary shockwave enters test chamber 308, detector 112 measures the pressure and temperature differentials created. Detector 112 will continue to take temperature and pressure measurements as the primary shockwave expands inside of test chamber 308.

Figure 4D:
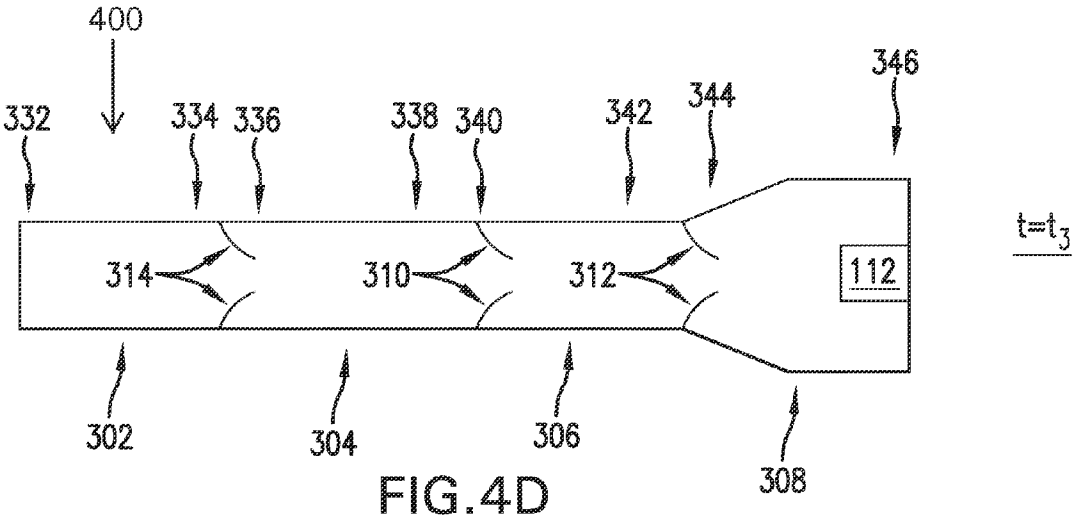

As shown in FIG. 4D, at time $t_3$, diaphragm 314 switches from a closed state to an open state. When diaphragm 314, switches from a closed state to an open state, the temperature and pressure differential between, tube section 302 and tube section 304, create a secondary shockwave. The secondary shockwave propagates from tube section 302 towards test chamber 308.

When the secondary shockwave reaches test chamber 308, detector 112 continues to take temperature and pressure measurements of the primary shock and secondary shock. Detector 112 continues to take temperature and pressure measurements until the primary shock and secondary shock have equalized inside of shock tube system 400.

The generated shock waves, as detected by detector 112, will now be further described with reference to FIG. 5.

Figure 5:
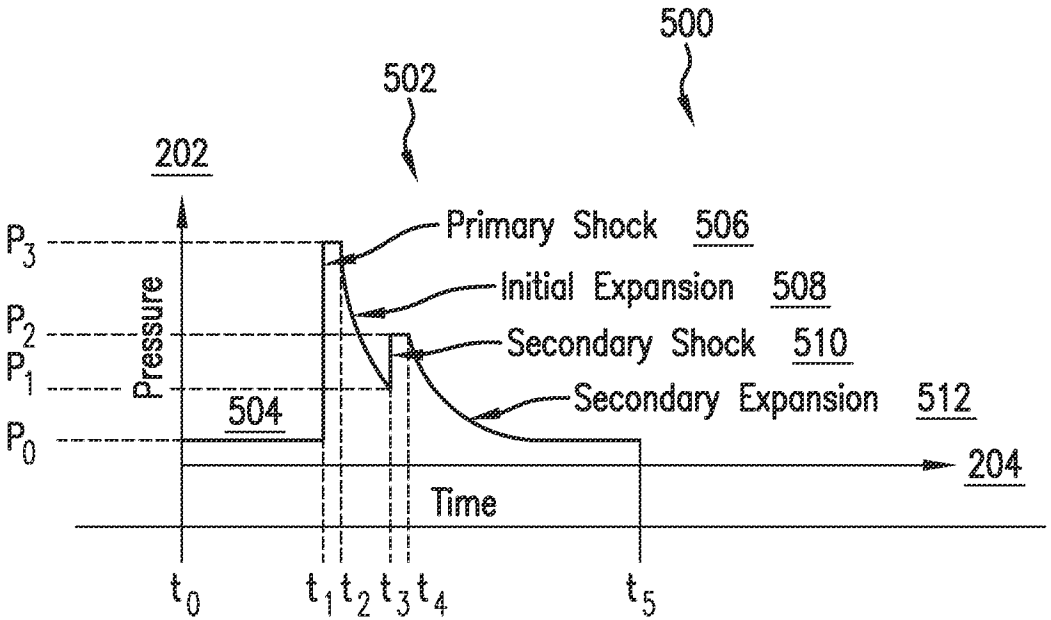
FIG. 5 illustrates pressure as a function of time in an example shock tube system in accordance with one embodiment of the present invention.

As illustrated in FIG. 5, graph 500 includes y-axis 202, x-axis 204 and a function 502. Function 502 includes a function segment 504, a function segment 506, a function segment 508, a function segment 510 and a function segment 512.

Function segment 504 has a constant pressure $p_0$ from time $t_0$ to time $t_1$. Function segment 506 has a maximum pressure $p_3$ from time $t_1$ to time $t_2$. Function segment 508 decreases from pressure $p_3$ at time $t_2$ to pressure $p_1$ at time $t_3$. Function segment 510 has a constant pressure $p_2$ from time $t_3$ to time $t_4$. Function segment 512 decreases from pressure $p_2$ at time $t_4$ to pressure $p_0$ at time $t_5$.

In operation, at time $t_0$ diaphragm 310 is in a closed state and acts as a barrier between tube section 304 and tube section 306. Additionally, at time $t_0$, diaphragm 312 is in a closed state and acts as a barrier between tube section 306 and test chamber 308. Additionally, at time $t_0$, diaphragm 314 is in a closed state and acts as a barrier between tube section 302 and tube section 304. When tube section 302, tube section 304, tube section 306, and test chamber 308 are separate, the pressure inside of test chamber 308 is at a constant $p_0$ as shown by function segment 504.

Function segment 506 represents the opening of diaphragm 310 at time $t_1$. At this time, diaphragm 310 switches from a closed state to an open state, allowing the flow of fluid from tube section 304 into tube section 306. A short time later, diaphragm 312 is opened allowing compressed gas to expand into the test chamber 308. The volume, temperature, and pressure differentials between tube section 304 and tube section 306 creates a primary shock with pressure $p_3$ that impacts detector 112 at time $t_2$.

At time $t_2$, as expansion wave propagates into the test chamber 301 and interacts with detector 112 resulting in a decaying pressure represented by function segment 508.

As shown by function segment 510, at time prior to time $t_3$, diaphragm 314 switches from a closed state to an open state, allowing a fluid from tube section 302 to flow into tube section 304 and tube section 306. The volume, temperature, and pressure differential between fluid in tube section 302 and the fluid mixture from tube section 304 and tube section 306 creates a secondary shock.

The secondary shock propagates from tube section 302 towards test chamber 308 and impacts detector 112 resulting in pressure $p_2$ from time $t_3$ to time $t_4$.

Function segment 512 represents the impingement of the expansion wave on detector 112 inside the test chamber 308. At time $t_4$ the secondary shock enters test chamber 308 and impacts detector 112 at time $t_4$. The equalization starts at time $t_4$ at pressure $p_2$ and continues until the fluid reaches an equilibrium pressure at time $t_5$.

Figure 6:
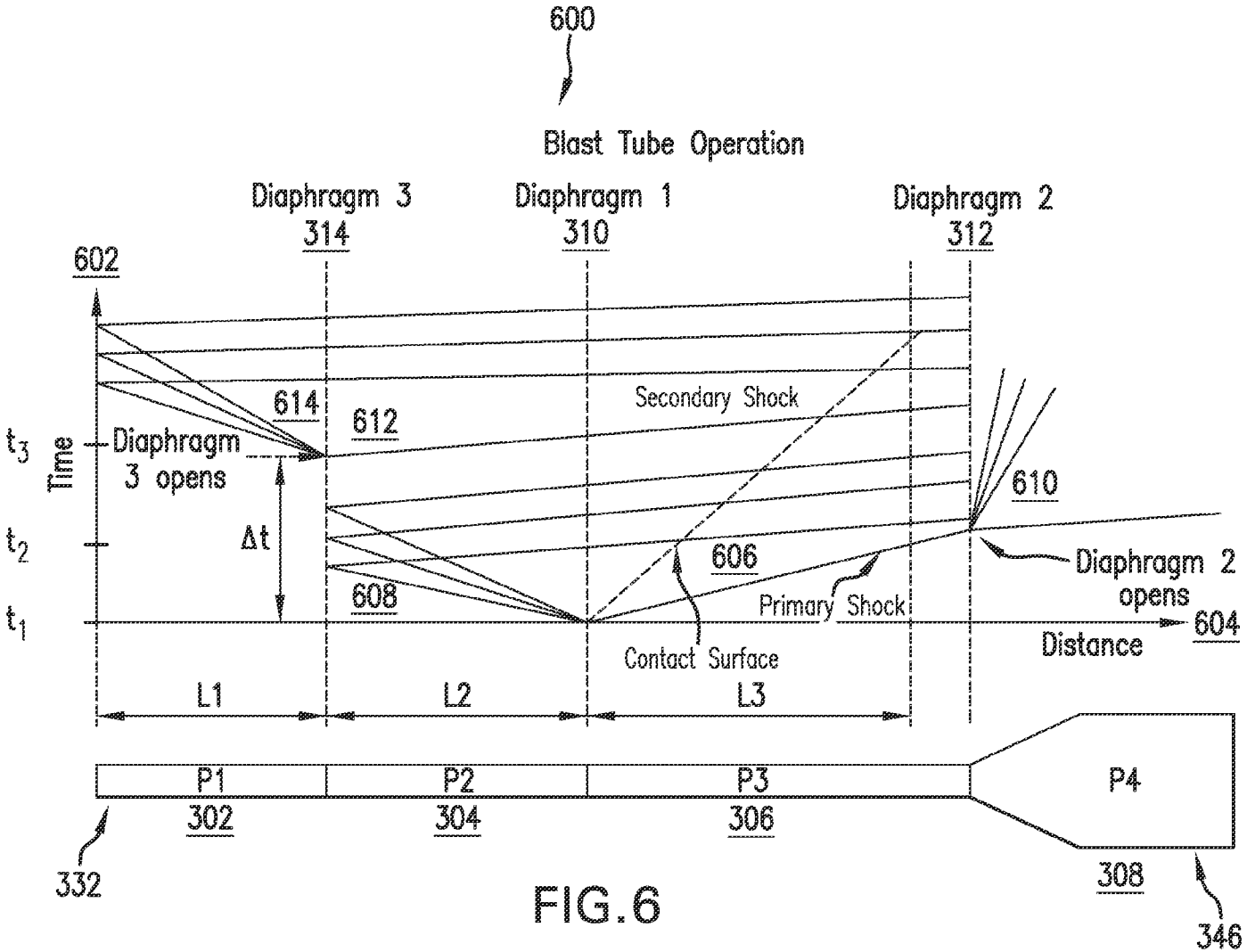
FIG. 6 illustrates the propagation of shockwaves as a function of time inside of an example shock tube system in accordance with one embodiment of the present invention.

FIG. 6 is a graph that illustrates shockwave distance inside blast tube system 300 described in FIG. 3 and FIGS. 4A-D as a function of time.

As illustrated in the graph, system 600 includes tube section 302, tube section 304, tube section 306, test chamber 308, diaphragm 310, diaphragm 312, diaphragm 314, a y-axis 602, an x-axis 604, a primary shock 606, a primary reverberation 608, a primary expansion 610, a secondary shock 612, and a secondary reverberation 614.

Y-axis 602 is time measured in milliseconds, whereas x-axis 604 is distance measured in feet.

Primary shock 606 illustrates the propagation of a shockwave through tube section 306 towards diaphragm 312 after diaphragm 310 opens time $t_1$.

Primary reverberation 608 illustrates the propagation of an expansion wave through tube section 304 after diaphragm 310 opens prior to time $t_1$. If test chamber 308 is closed at the end wall 346, as it would be for studying shockwaves in an enclosed space, primary shock 606 will hit end wall 346 of test chamber 308 and be reflected back towards diaphragm 314 as primary reverberation 608.

When primary reverberation 608 contacts diaphragm 314 it changes direction and begins to propagate towards test chamber 308. This reaction continues on creating many reflections throughout the experiment.

Primary expansion 610 results following propagation of primary shock 606, after diaphragm 312 opens at time $t_2$, inside of test chamber 308.

Secondary shock 612 illustrates the propagation of a second shockwave, after diaphragm 314 opens at time $t_3$, through tube section 304, tube section 306, and into test chamber 308.

Secondary reverberation 614 illustrates the propagation of a second expansion wave through tube section 302 after diaphragm 314 opens at time $t_3$. If test chamber 308 were closed at end wall 346, as it would be for studying shockwaves in an enclosed space, secondary shock 612 will hit end wall 346 of test chamber 308 and be reflected back towards end wall 332 of tube section 302.

When secondary reverberation 614 impacts the end wall 332 of tube section 302 it changes direction and begins to propagate towards test chamber 308. This re action continues on creating many reflections throughout the experiment.

In operation, tube section 302, tube section 304 and tube section 306 will have initially been filled with fluid to a predetermined volume, temperature and pressure. At time $t_1$ diaphragm 310 is opened and fluid from tube section 304 and tube section 306 are allowed to interact. The temperature and pressure differentials between tube section 304 and tube section 306 creates a primary shock 606.

Primary shock 606 propagates towards diaphragm 312 as shown in FIG. 6. The opening of diaphragm 310 also creates primary reverberation 608 which propagates backwards towards diaphragm 314. When primary reverberation 608 contacts diaphragm 314 it changes direction and begins to propagate towards diaphragm 312.

At time $t_2$, diaphragm 312 switches from a closed state to an open state. This state change of diaphragm 312 allows primary shock 606 and primary reverberation 608 to enter test chamber 308. Primary expansion 610 illustrates the expansion of fluid inside of test chamber 308 after time $t_2$.

At time $t_3$, diaphragm 314 switches from a closed state to an open state creating a secondary shock. The opening of diaphragm 314 occurs after primary reverberation 608 has bounced off of diaphragm 314 and is propagating towards test chamber 308. If diaphragm 314 opened be fore this point, primary reverberation 608 would cause interference in the generation of secondary shock 612.

Once diaphragm 314 opens, the temperature and pressure differentials between tube section 302 and tube section 304 creates a secondary shock 612. Secondary shock 612 will propagate towards test chamber 308 as shown in FIG. 6.

The opening of diaphragm 314 at time $t_3$ also creates a secondary reverberation 614. Secondary expansion 614 propagates towards the end wall of tube section 302, once contact is made, it is reflected and begins to propagate towards test chamber 308.

Figure 7A:
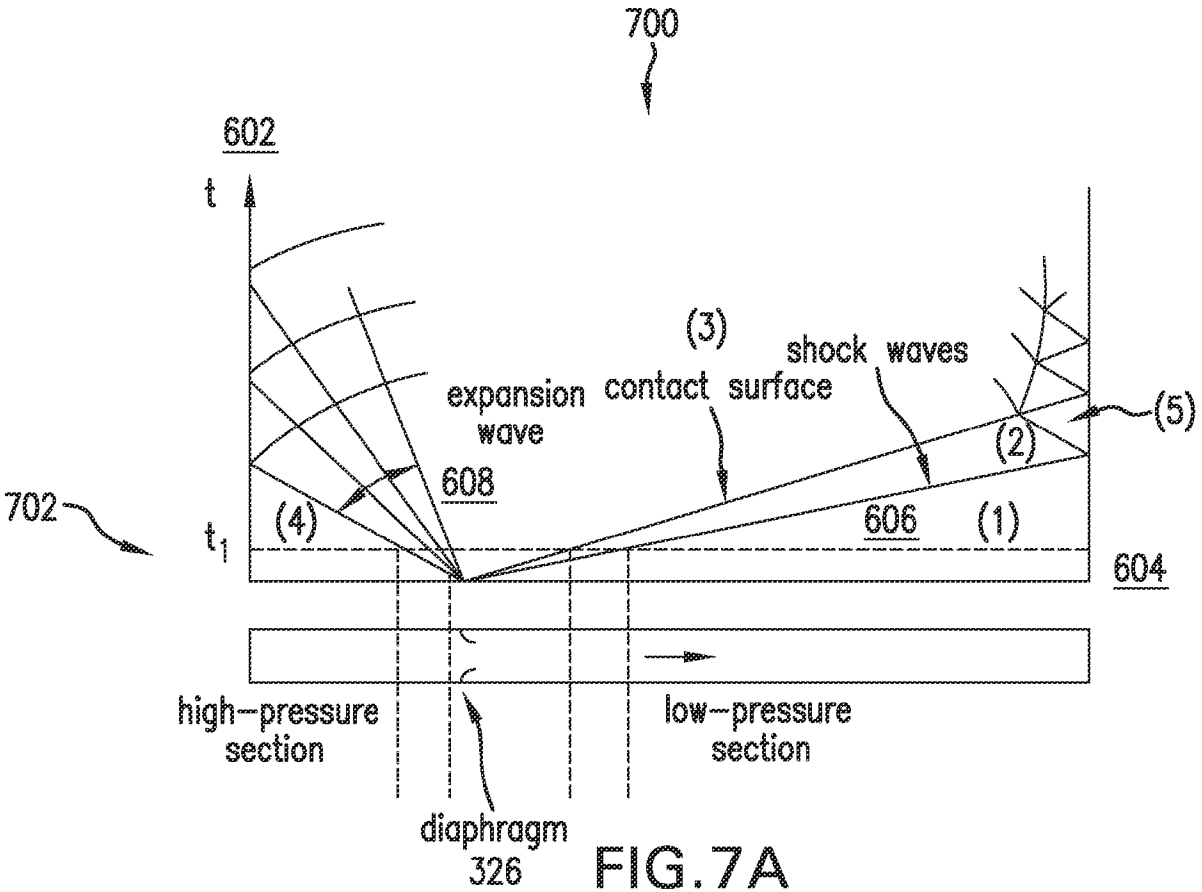
FIGS. 7 A-C illustrate the temperature and pressure at time $t_1$ inside of an example shock tube system in accordance with one embodiment of the present invention.
Figure 7B:
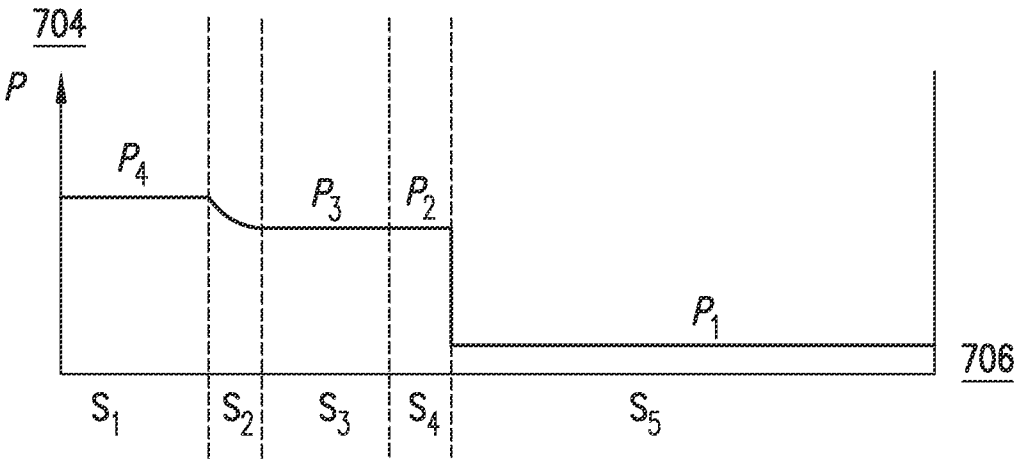
Figure 7C:
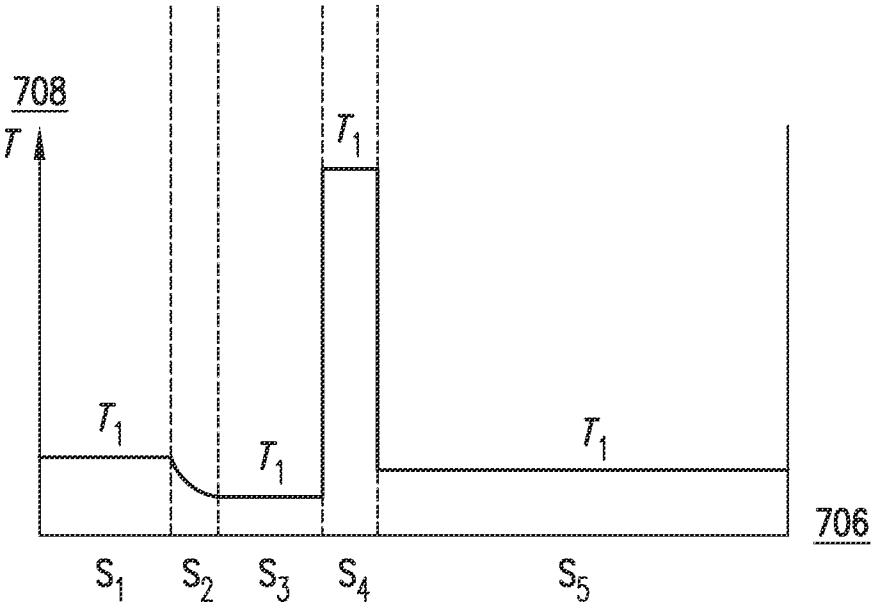

FIGS. 7A-C illustrate shockwave propagation distance as a function of time inside of an example shock tube system 700 at a time $t_1$.

As illustrated in the graphs, system 700 includes y-axis 602, x-axis 604, primary shock 606, primary expansion 608, a time $t_1$ 702, a y-axis 704, an x-axis 706, and a y-axis 708.

Line 702 is the line that crosses FIG. 7A at time $t_1$.

Y-axis 704 is the axis on which pressure is measured in FIG. 7B at a constant time $t_1$. Y-axis 708 is the axis on which temperature is measured in FIG. 7C, for cross section 702 at a constant time $t_1$. X-axis 706 is the axis on which distance is measured for FIG. 7B and FIG. 7C for cross section 702 at a constant time $t_1$.

In operation, when diaphragm 312 is opened primary shock 606 is created. If end wall 346 of test chamber 308 is closed, primary shock 606 will re fleet off of end wall 346 back towards the high pressure tube section as primary expansion 608.

Primary expansion 608 will reflect back towards test chamber 308, this process of shock reflection will continue for the duration of the experiment.

At a time $t_1$ cross section 702 is taken. Cross section 702 marks the time at which FIG. 7B and FIG. 7C are evaluated.

In FIG. 7B section $S_1$ represents the high pressure section of the blast tube system. The pressure is highest in section $S_1$ with a pressure $P_4$.

Section $S_2$ represents the section of the blast tube system in which fluid from the high pressure section begins moving towards the low pressure section. As illustrated there is a pressure drop from pressure $P_4$ to pressure $P_3$.

In section $S_3$, there is a pressure $P_3$ which is the same as pressure $P_2$ in section $S_4$. The equality of the pressures between these two sections represents the contact surface.

Section $S_5$ has a pressure $P_1$. This section has the lowest pressure and represents the tube section in which the high pressure fluid has not yet moved into.

In FIG. 7C section $S_1$ represents the temperature $T_4$ of the high pressure section of the blast tube system.

There is a temperature drop from $T_4$ to $T_3$ in section $S_2$. This temperature drop represents the expansion of fluid from the high pressure section into the low pressure section after the opening of diaphragm 310.

In section $S_4$ there is a maximum temperature $T_2$. This high temperature spike represents the primary shock 606 wave front. As the wave front propagates down the low pressure section of the blast tube system, the temperature spike will also move.

There is a temperature $T_4$ in section $S_5$. This is the original temperature of the low pressure tube section. The temperature will remain unchanged until primary shock 606 disturbs the fluid by propagating through it towards a test chamber.

Figure 1:
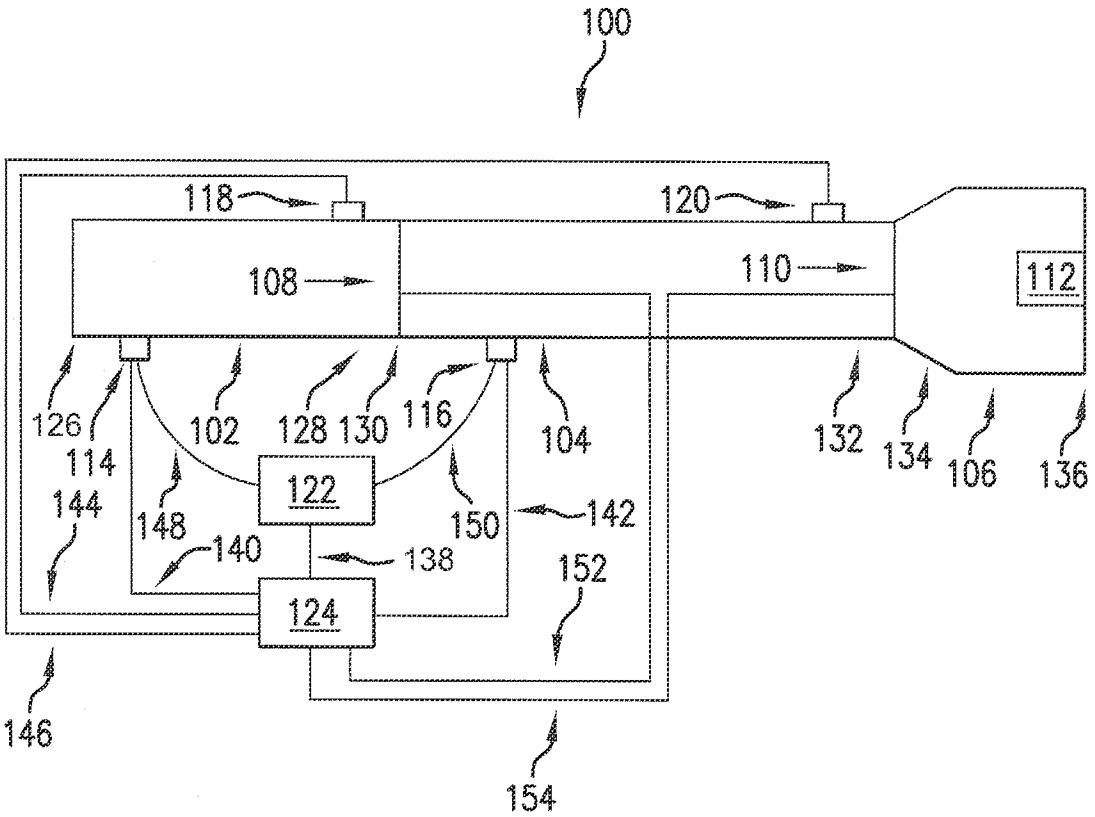
FIG. 1 (PRIOR ART)
FIG. 1 illustrates a conventional shock tube system.
Figure 2:
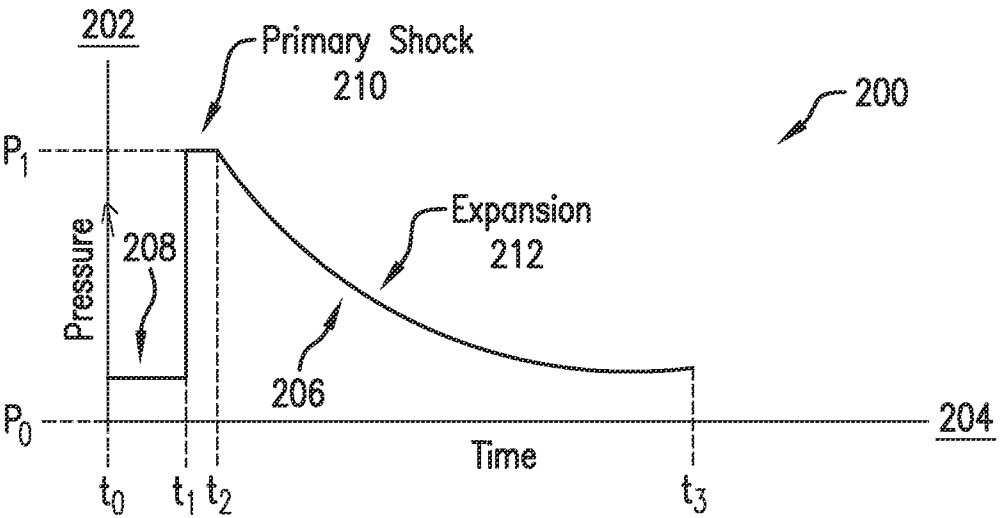
FIG. 2 (PRIOR ART)
FIG. 2 illustrates the pressure inside of the shock tube system shown in FIG. 1 as a function of time.

The conventional blast tube system illustrated in FIG. 1 was composed of two blast tube sections separated by a single diaphragm. As a result, this could provide a primary shockwave but was still insufficient for creating multiple shockwaves and manipulation of the shockwaves that were generated.

In accordance with example embodiments of the present invention, a blast tube with more than two tube sections that are interchangeable allow for shockwave timing control by means of shock tube system length. In the example embodiments discussed above, a blast tube system employs three tube sections. However, in other embodiments more tube sections may be used to generate additional, subsequent shock waves.

Two sets of diaphragms are used to control the precise timing between the primary shockwave and the generation of a secondary shock. Any known method of opening the diaphragms may be employed for a high degree of reproducibility.

The end of the blast tube system known as the expansion chamber may be open or closed, allowing for shockwaves to be created simulating open field or confined space explosions.

The design of the shock tube system can create more accurate simulations of enhanced blast weaponry can be produced in a laboratory setting. The design may be modified by changing cross-sectional area and shape of any of the blast tube sections. Further, the design may by modified by changing the length of any of the blast tube sections. A blast tube 20 system in accordance with example embodiments of the present invention may be used for injury treatment, damage mitigation and prediction methods associated with blasts.

The foregoing description of various example embodiments of the invention have been presented for purposes of illustration and description. It is not intended to be exhaustive or to limit additional embodiments of the invention to the precise forms disclosed, and various modifications and variations are possible in light of the teachings herein. The example embodiments, as described above, were chosen and described to explain the principles of the invention and its practical application to thereby enable others of ordinary skill in the art to best utilize the invention in various embodiments and with various modifications as are suited to the particular use contemplated. It is intended that the scope of the invention be defined by the claims appended hereto.

What is claimed is:

1. A blast tube comprising:

a first portion having a first inlet valve, a first outlet valve, a first length and a first cross section;

a second portion, adjacent to the first portion and having a second inlet valve, a second outlet valve, a second length and a second cross section;

a third portion, adjacent to the second portion and having a third inlet valve, a third outlet valve, a third length and a third cross section;

a first diaphragm operable to switch from a closed state to an open state at a first time, said first diaphragm being disposed between said second portion and said third portion;

a second diaphragm operable to switch from a closed state to an open state at a second time after the first time; and a third diaphragm operable to switch from a closed state to an open state at a third time after the second time, said third diaphragm being disposed between said first portion and said second portion, wherein said third portion is disposed between said first diaphragm and said second diaphragm.

2. The blast tube of claim 1, wherein said first diaphragm is operable to switch from the closed state to the open state based on a difference in a pressure within said second portion and a pressure within said third portion.

3. The blast tube of claim 1, wherein said third diaphragm is operable to switch from the closed state to the open state based on a difference in a pressure within said first portion and a pressure within said second portion.

4. The blast tube of claim 1, wherein said second diaphragm is operable to switch from the closed state to the open state based on a pressure within said third portion.

5. The blast tube of claim 1, wherein one of said first diaphragm, said second diaphragm and said third diaphragm is operable to switch from the closed state to the open state based on an electrical actuation signal.

6. The blast tube of claim 1, wherein one of said first diaphragm, said second diaphragm and said third diaphragm is operable to switch from the closed state to the open state based on a thermal actuation.

7. A method of operating a blast tube including a first portion, a second portion, a third portion, a first diaphragm, a second diaphragm and a third diaphragm, the first portion including a first length and a first cross section, the second portion including a second length and a second cross section, the third portion including a third length and a third cross section, the first diaphragm being operable to switch from a closed state to an open state, the first diaphragm being disposed between the second portion and the third portion, the second diaphragm being operable to switch from a closed state to an open state, the third diaphragm being operable to switch from a closed state to an open state, the third diaphragm being disposed between the first portion and the second portion, the third portion being disposed between the first diaphragm and the second diaphragm, said method comprising:

establishing a first pressure within the first portion;

establishing a second pressure within the second portion;

establishing a third pressure and a first temperature within the third portion before a first time;

switching the first diaphragm from the closed state to the open state at the first time;

switching the second diaphragm from the closed state to the open state at a second time after the first time; and switching the third diaphragm from the closed state to the open state at a third time after the second time.

8. The method of claim 7, wherein said switching the first diaphragm from the closed state to the open state at a first time comprises switching the first diaphragm from the closed state to the open state at a first time based on a difference between the second pressure and the third pressure.

9. The method of claim 7, wherein said switching the third diaphragm from the closed state to the open state at a third time after the second time comprises switching the third diaphragm from the closed state to the open state at a third time after the second time based on a difference between a pressure in the second portion after the first time and the first pressure.

10. The method of claim 7, wherein said switching the first diaphragm from the closed state to the open state at a first time comprises switching the first diaphragm from the closed state to the open state at a first time based on an electrical actuation signal.

11. The method of claim 7, wherein said switching the first diaphragm from the closed state to the open state at a first time comprises switching the first diaphragm from the closed state to the open state at a first time based on a thermal actuation.

12. The method of claim 7, further comprising establishing the first temperature within the first portion before the first time.

13. The method of claim 7, further comprising establishing a second temperature within the second portion before the first time.

14. The method of claim 7, further comprising establishing the first temperature within the first portion before the first time.

15. The method of claim 7, further comprising establishing the first temperature within the second portion before the first time.

16. The method of claim 7, wherein said establishing a first pressure within the first portion comprises providing a first gas into the first portion.

17. The method of claim 16, wherein said establishing a second pressure within the second portion comprises providing a second gas into the second portion.

18. The method of claim 17, wherein said establishing a third pressure within the third portion comprises providing a third gas into the third portion.

19. A system comprising:

a blast tube including a first portion, as second portion, a third portion, a first diaphragm, a second diaphragm and a third diaphragm, said first portion having a first inlet valve, a first outlet valve, a first length and a first cross section, said second portion having a second inlet valve, a second outlet valve, a second length and a second cross section, said third portion having a third inlet valve, a third outlet valve, a third length and a third cross section, the first diaphragm being operable to switch from a closed state to an open state at a first time, said first diaphragm being disposed between said second portion and said third portion, said second diaphragm being operable to switch from a closed state to an open state at a second time after the first time, said third diaphragm being operable to switch from a closed state to an open state at a third time after the second time, said third diaphragm being disposed between said first portion and said second portion, said third portion being disposed between said first diaphragm and said second diaphragm;

a compressor operable to provide a first amount of a first gas to the first inlet valve, to provide a second amount of a second gas to said second inlet valve and to provide a third amount of a third gas to said third inlet valve;

a controller operable to control said compressor; and a detector operable to detect a shock wave, wherein said third portion is disposed between said second portion and said detector.

* * * * *